US006354006B1

(12) United States Patent
Castelmani

(10) Patent No.: US 6,354,006 B1
(45) Date of Patent: Mar. 12, 2002

(54) CHAIN SAW FOR BRANCH CUTTING

(76) Inventor: Franco Castelmani, Via dei Caccioni, 8, 00025 Gerano (IT)

( * ) Notice: Subject to any disclaimer, the term of this patent is extended or adjusted under 35 U.S.C. 154(b) by 0 days.

(21) Appl. No.: 09/507,656

(22) Filed: Feb. 22, 2000

(30) Foreign Application Priority Data

Feb. 23, 1999 (IT) ..... RM99A0119

(51) Int. Cl.[7] ..... B27B 17/00
(52) U.S. Cl. ..... 30/123.4; 30/296.1
(58) Field of Search ..... 30/381, 382, 383, 30/384, 385, 386, 123.4, 296.1

(56) References Cited

U.S. PATENT DOCUMENTS 2,409,775 A * 10/1946 Mall et al. ..... 30/123.4
2,852,046 A * 9/1958 Kiekhaefer ..... 30/123.4
3,774,303 A * 11/1973 Burkett et al. ..... 30/382
4,256,436 A * 3/1981 Fandrey et al. ..... 415/143
4,738,600 A * 4/1988 Safford ..... 417/403
4,760,646 A * 8/1988 Siegler ..... 30/382
5,079,993 A * 1/1992 Forster ..... 91/484
5,653,028 A * 8/1997 Hashimoto ..... 30/123.4

* cited by examiner

*Primary Examiner*—Kenneth E. Peterson
*Assistant Examiner*—Stephen Choi
(74) *Attorney, Agent, or Firm*—Harrison & Egbert

(57) ABSTRACT

A chain saw for cutting branches of up to 200 mm in diameter and above, including a main body, a self-priming pump, a joint, a positioning washer, a collar bracket, an oil sump, hook supports and a blade. It falls within the technical field of human requirements and within the application field of instrument and tool manufacturing. It will cut branches within arm's reach and if a telescopic extension is fitted it will cut branches at any desired height. It is easily operated and as a result of the ease with which the parts may be replaced it is easily maintained and therefore very reliable.

2 Claims, 4 Drawing Sheets

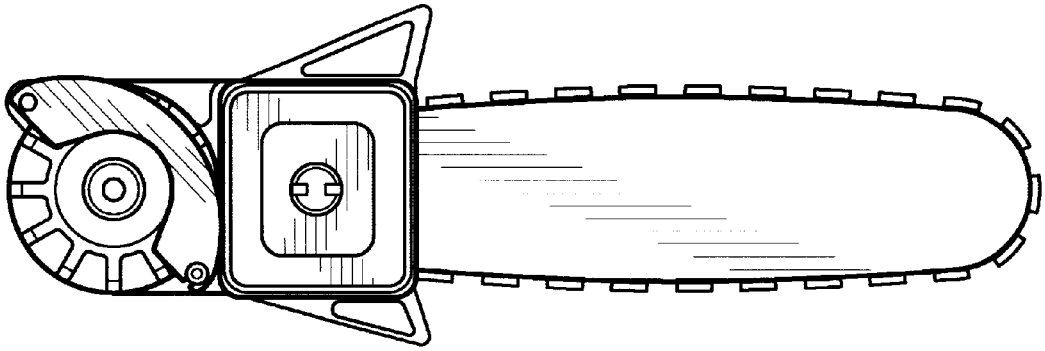
FIG. 1
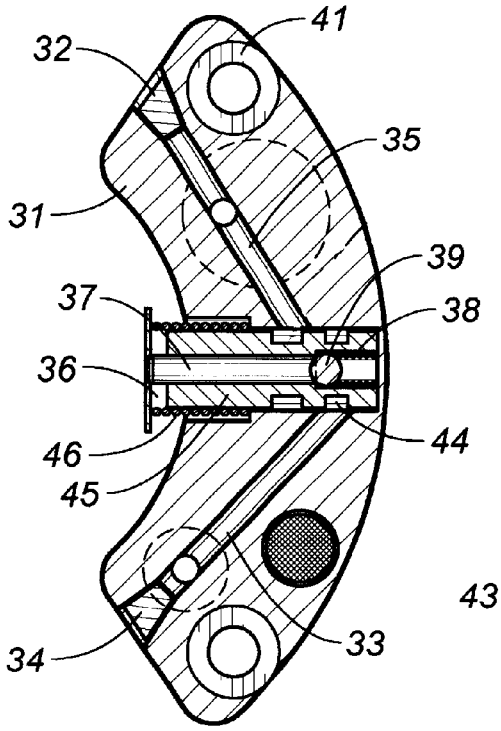
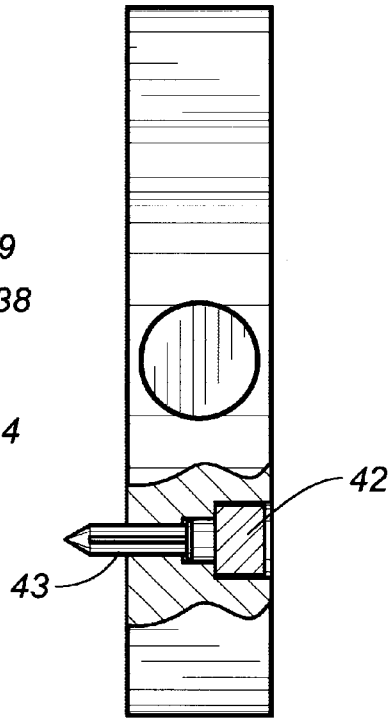
FIG. 2 FIG. 3

CHAIN SAW FOR BRANCH CUTTING

BACKGROUND ART

The invention concerns a tool for cutting branches with diameters of up to 200 mm and above. High branches may be cut by fitting a telescopic extension piece. The cutting of branches is easy and safe with this tool. The tool is designed in such a way that, if any parts become unloosened the bracket will not release itself from the bevel gear pair and the tool will therefore not fall, which is the most dangerous of all possible occurrences. The safety of the toll is also guaranteed by the semi-truncated bell-shaped element which ensures that the same protection is provided by means of the ring nut which, once tightened, is blocked with a safety rod. The tool therefore guarantees a very high level of safety, which is an absolute requirement for compliance with EU regulations.

TECHNICAL FIELD

The invention falls within the technical field of human requirements and within the application field of instrument and tool manufacturing

SUMMARY OF THE INVENTION

The tool may be easily used either during professional activities or for hobby purposes.

It may used directly by the operator or fixed to a rod fitted with a bevel gear pair to which the DC or AC driving power is provided by an internal combustion engine. It has been rationally designed and the manufacture and maintenance is easy. An interesting point is that, as shown in more detail below, the parts from which it is formed such as oil tank, pump, filters, positioning washer, collar or bell-shaped bracket, oil sump, blade and chain are easily and rapidly removed and replaced.

This invention is more easily operated and maintained than previous solutions as a result of the above-mentioned ease with which parts may be removed and replaced.

BRIEF DESCRIPTION OF THE DRAWINGS

The invention is described below, where reference is made to the current version and the following drawings, which are attached herewith.

FIG. 1 is a schematic diagram of the tool.

FIG. 2 is a sectional view of the self-priming pump

FIG. 3 is a side view of the self-priming pump.

DETAILED DESCRIPTION OF THE INVENTION

Figure 4:
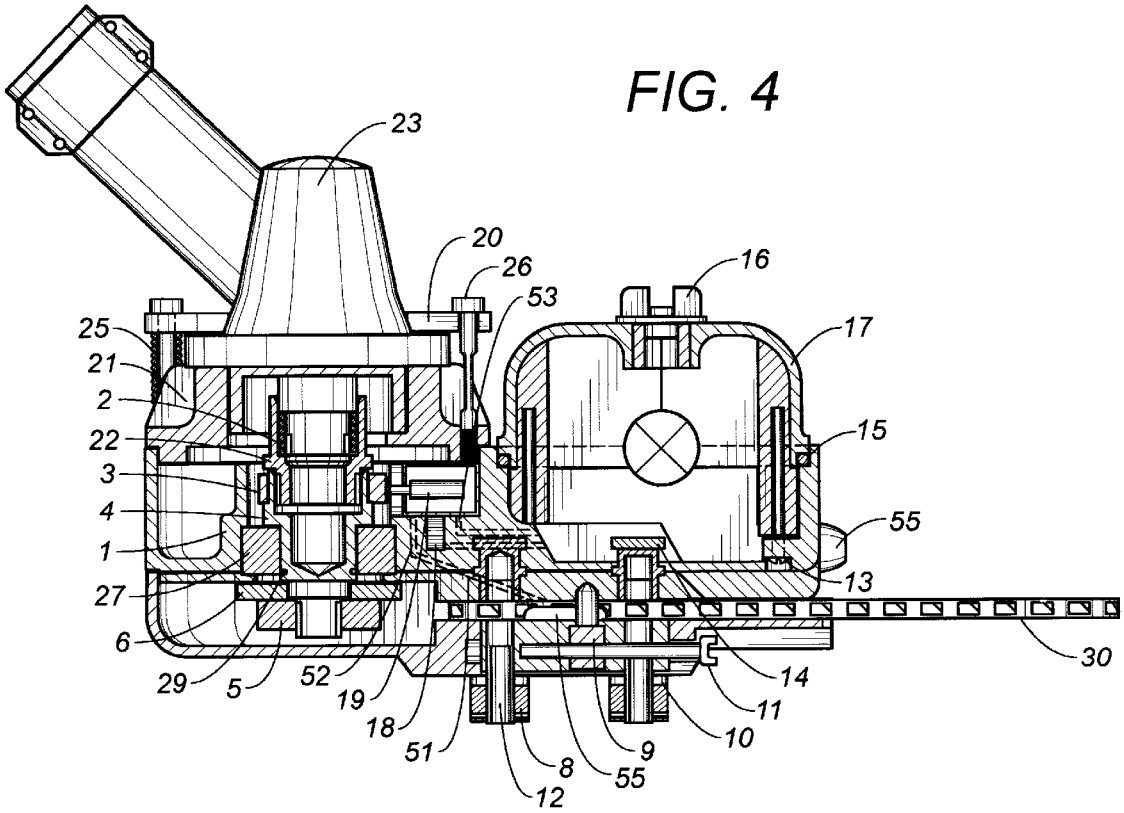
FIG. 4 is a schematic sectional view of the tool.

This tool is used for cutting branches. It is formed by a main body, a self-priming pump, a joint, a positioning washer, a collar bracket, an oil sump, hook supports, stud inserts, etc. Main body 1 holds bearing 27 which has the role of holding the transmission axis 4, an oil tank 16 which contains the chain lubrication oil, two or more inserts 14 which are necessary to fix the oil sump and the blade, a pump 19 to send the oil from the tank to the inlet at the chain, an oil filter 18, a transmission axis 4 to run on the bearing 27, a joint 22, a pre-loading spring 2 for the bevel gear pair, a positioning washer 21, a pre-loading screw for a pre-loading spring 25 and another tenon captive screw 26 to fix the bracket 20 to the collar, a bevel gear pair 23, a cam 3, an adjustment washer 6 and a transmission reel 5, a ring seal 29, two studs 12, four or more fixing screws 13, a plug with gasket 16 for the tank 17, a ring seal 15, a protection sump 7, two bushes 10 for nut support, a screw 11 to regulate the chain blade, a chain-tensioning pin 9, two-self-blocking nuts 8. A low profile chain runs around the blade 30. The main body 1 is fitted with an inlet hold 51 for the passage of oil, a discharge hole 52, and an air inlet hole 53 to the tank. The self-priming pump is without doubt an original aspect of the invention. It has been specifically designed for use in the tool in question and is formed by a main body 31, a plug 32 for pipe 35 for oil suction, a pipe 33 for oil discharge, a plug 34, a cap 36 for contact with the cam, a piston 37 for oil pumping, a valve formed by a spring 38 and a ring seal 39, a calibrated hole for oil suction, hole 41 to fix the pump screws, a sintered filter 42 for suction of air from the tank, a check valve 43 to reset the air circuit, a hole 44 for oil discharge, a pump cylinder 45, a piston return spring 46.

Joint 22 which fits in shaft 4 is replaceable with others depending on the power output which is used.

Figures 5, 6:
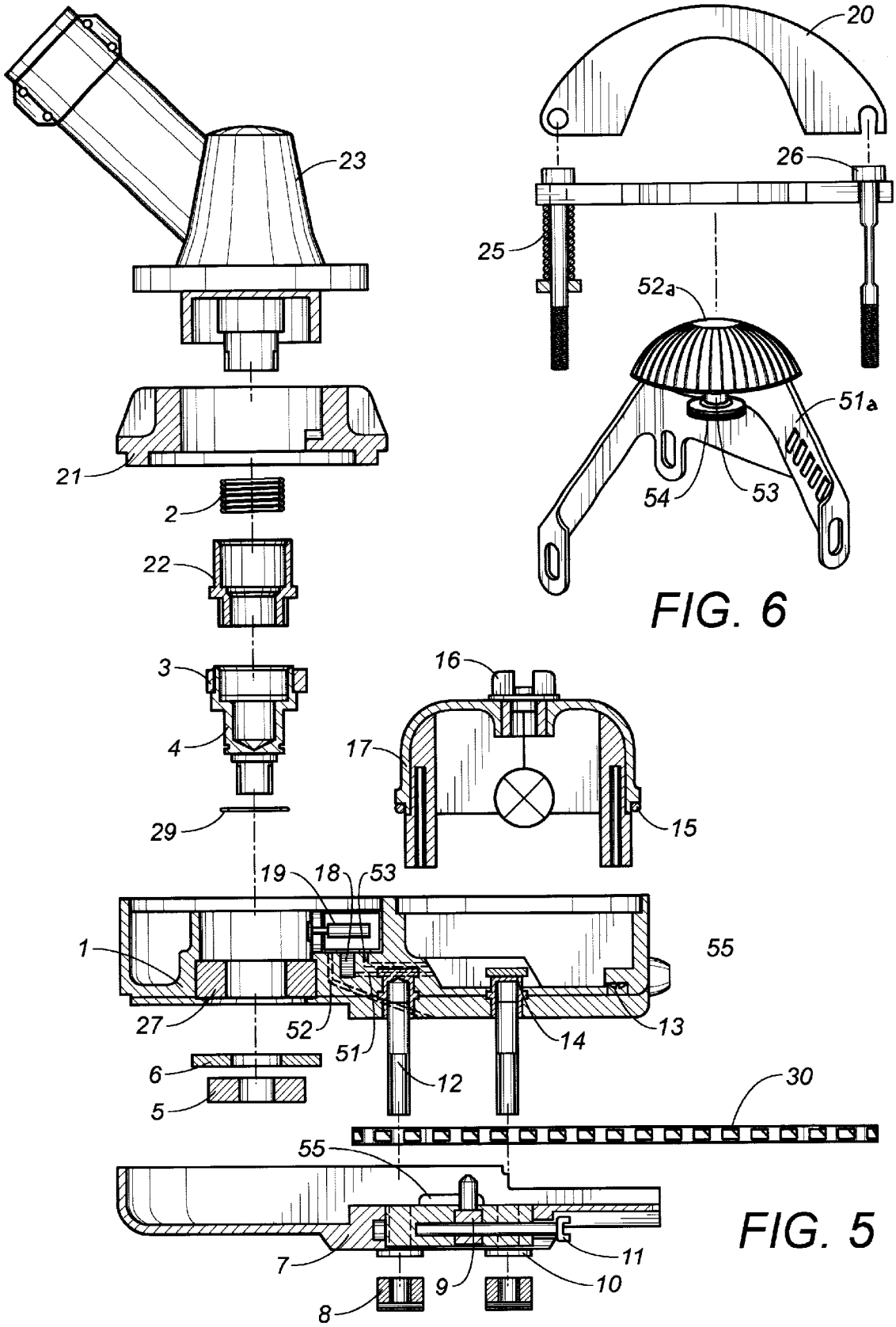
FIG. 5 is a schematic exploded view of the tool.
FIG. 6 is a detailed of clamp and truncated cone.
Figure 7A:
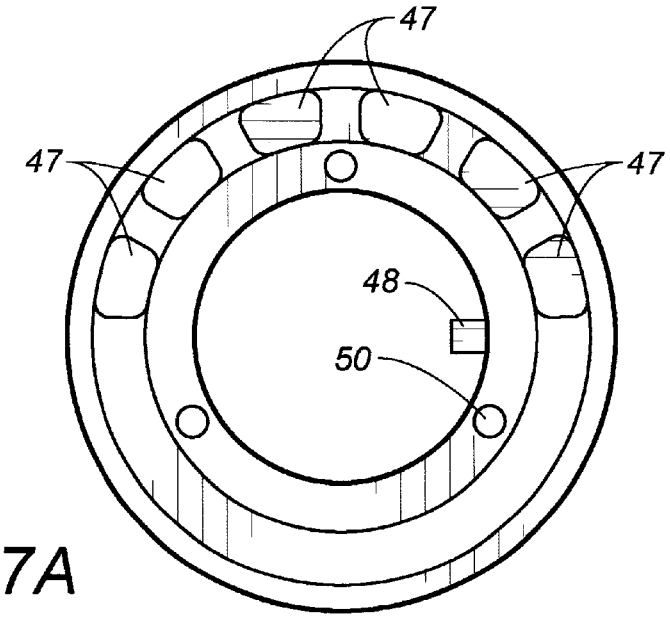
FIG. 7A is a bottom view of the positioning washer.
Figure 7B:
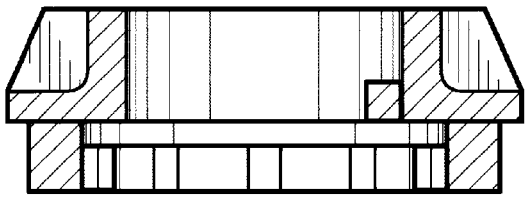
FIG. 7B is a side view of the positioning washer.
Figure 7C:
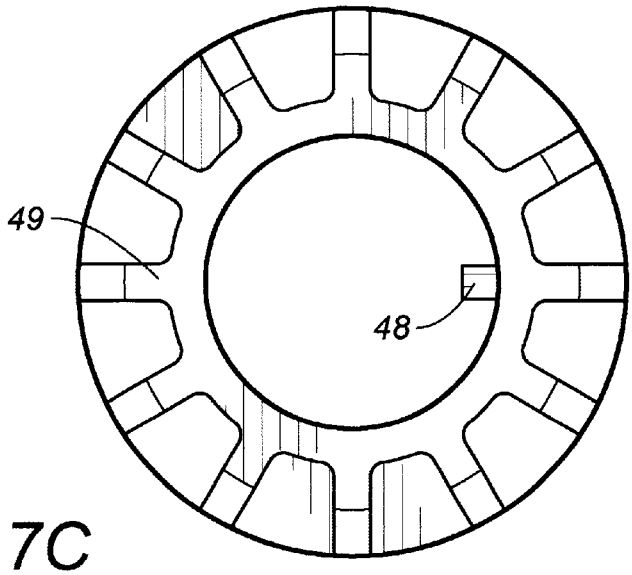
FIG. 7C is a top view of the positioning washer.

Positioning washer 21 is formed by position 47 for the angular positioning of the tool, a blocking device 48, spoked elements 49. It is fitted with air inlet holes 50. The bracket 20 may also be replaced by a semi-truncated bell-shaped element 51*a*. FIG. 6, fitted with ring nut 52*a* in which a threaded rod is fitted 53*a* which ends with a washer 54 covered with a layer of anti-slip rubber. The hook supports 55 fitted to the main body 1 are asymmetric in order to make it easier to determine the side on which the cut must be made.

I claim:

1. A chain saw apparatus for cutting branches comprising:

a main body;

a chain extending from said main body;

a self-priming pump affixed within said main body;

a joint positioned within said main body;

a positioning washer secured to said main body around said joint;

a collar bracket comprising a semi-truncated bell-shaped element affixed at one end to said main body;

an oil sump affixed to said main body;

a plurality of hook supports positioned on said main body around said oil sump;

a plurality of stud inserts secured to said oil sump and inserted into said main body so as to fix said oil sump to said main body;

a bearing supported on said main body;

a tank connected to said main body and suitable for receiving chain lubrication oil therein;

a pump means affixed to said main body and communicating with said tank, said pump means for passing the oil from said tank to said chain;

an oil filter means contained within said pump means for filtering debris from the oil passing to said chain;

a transmission axis received within said bearing;

a spring extending around said transmission axis;

a pre-loading screw engaged with said positioning washer retaining said positioning washer against said main body;

a spring element resiliently interposed between a head of said pre-loading screw and said positioning washer;

a tenon screw connected to said collar bracket and secured to said main body;

a seal ring extending around said tank;

two nut support bushes retaining said oil sump against said main body;

a chain regulating screw affixing a blade of said chain to said main body;

a chain tensioning pin means connected to said main body for setting a tension of said chain around said blade;

two self-locking nuts respectively engaged with said plurality of stud inserts so as to retain said chain tensioning pin means against said blade, said chain running around said blade;

an oil inlet hole in communication with said tank and formed in said main body;

an oil discharge hole extending to said pump and formed in said main body; and an air inlet hole communicating with an interior of said tank.

2. Chain saw for cutting branches, according to claim 1, wherein said semi-truncated bell-shaped element is fitted with a ring nut in which a threaded rod is fitted, said threaded rod having a washer at an end, said washer being covered with a layer of anti-slip rubber.

* * * * *